US007254896B2

(12) United States Patent
Carr et al.

(10) Patent No.: US 7,254,896 B2
(45) Date of Patent: Aug. 14, 2007

(54) INNER BEARING SPLIT AXLE ASSEMBLY

(75) Inventors: Gary A. Carr, Fairfax, VA (US); Cameron D. Stuart, Springfield, VA (US); Jeffrey A. Bloom, Silver Spring, MD (US)

(73) Assignee: ENSCO, Inc., Springfield, VA (US)

( * ) Notice: Subject to any disclaimer, the term of this patent is extended or adjusted under 35 U.S.C. 154(b) by 332 days.

(21) Appl. No.: 10/390,188

(22) Filed: Mar. 18, 2003

(65) Prior Publication Data

US 2004/0020065 A1 Feb. 5, 2004

Related U.S. Application Data

(60) Provisional application No. 60/364,604, filed on Mar. 18, 2002.

(51) Int. Cl.
*E01B 35/02* (2006.01)

(52) U.S. Cl. ..... 33/338; 33/1 Q; 33/651; 33/287; 33/523.1; 33/203.18; 73/146; 295/36.1

(58) Field of Classification Search ..... 33/1 Q, 33/338, 651, 287, 523.1, 533, 521, 203.18; 73/146; 295/36.1; 301/128; 105/178
See application file for complete search history.

(56) References Cited

U.S. PATENT DOCUMENTS

| | | | | | |
|---|---|---|---|---|---|
| 441,014 | A | * | 11/1890 | Mahood | 295/38 |
| 1,190,796 | A | * | 7/1916 | Pollard | 33/331 |
| 2,829,438 | A | * | 4/1958 | Cutler | 33/523.1 |
| 3,505,742 | A | * | 4/1970 | Fiechter | 33/338 |
| 3,543,576 | A | * | 12/1970 | Bishop | 73/146 |
| 3,630,077 | A | * | 12/1971 | Boileau | 73/146 |
| 3,643,503 | A | | 2/1972 | Plasser et al. | |
| 3,718,040 | A | * | 2/1973 | Freeman et al. | 73/146 |
| 3,808,693 | A | | 5/1974 | Plasser et al. | |
| 3,816,927 | A | | 6/1974 | Theurer et al. | |
| 3,869,907 | A | | 3/1975 | Plasser et al. | |
| 3,968,752 | A | * | 7/1976 | Theurer | 33/287 |
| 4,095,374 | A | * | 6/1978 | Ugo | 73/146 |
| 4,529,241 | A | * | 7/1985 | Jungbert | 295/39 |
| 4,679,447 | A | * | 7/1987 | Sieradzki et al. | 73/865.8 |

(Continued)

FOREIGN PATENT DOCUMENTS

| | | | | |
|---|---|---|---|---|
| DE | 2224966 B | * | 5/1972 | 33/1 Q |

(Continued)

*Primary Examiner*—G. Bradley Bennett
*Assistant Examiner*—Travis Reis
(74) *Attorney, Agent, or Firm*—Nixon & Peabody LLP; Jeffrey L. Costellia

(57) ABSTRACT

A split axle assembly for obtaining gage measurements of a track including a first wheel with a first split axle, a second wheel with a second split axle, a first bearing for rotatably receiving the first split axle, and a second bearing for rotatably receiving the second split axle, the first bearing and the second bearing being positioned inboard between the first wheel and the second wheel. In one embodiment, a sliding barrel device is provided. In another embodiment, the first bearing is received in a first bearing body and the second bearing is received in a second bearing body so that they are axially movable relative to one another. At least one linear guide is provided to allow axial movement of the first bearing body and the second bearing body relative to one another.

30 Claims, 5 Drawing Sheets

U.S. PATENT DOCUMENTS 4,696,506 A * 9/1987 Leo et al. ..... 295/38
RE32,631 E * 3/1988 Layer ..... 73/766
5,614,676 A * 3/1997 Dutt et al. ..... 73/660
5,649,490 A 7/1997 Lovitt
5,756,903 A * 5/1998 Norby et al. ..... 73/786
6,293,022 B1 * 9/2001 Chino et al. ..... 33/203.18

FOREIGN PATENT DOCUMENTS

JP 01059025 A * 3/1989
JP 06124121 A * 5/1994

* cited by examiner

INNER BEARING SPLIT AXLE ASSEMBLY

BACKGROUND OF THE INVENTION

This application claims priority to U.S. Provisional Application No. 60/364,604, filed Mar. 18, 2002.

FIELD OF THE INVENTION

The present invention relates to an axle assembly for rail vehicles such as railcars, subway cars trains, trolleys and the like. In particular, the present invention relates to such an axle assembly that includes a split axle assembly which allows the wheels to move axially inward and outwardly with reduced binding.

Description of Related Art

To ensure safe operation of trains, railcars, subway cars, trolleys and the like, devices have been used to measure gage restraint such as track stiffness and/or tie conditions. Examples of such devices are shown in U.S. Pat. No. 3,643,503 to Plasser et al., U.S. Pat. No. 3,816,927 to Theurer et al., and U.S. Pat. No. 3,869,907 to Plasser, deceased et al. In addition, devices have been designed to apply predetermined lateral force on the track, and to measure the lateral displacement to determine how much the track displaces under the predetermined and measured, lateral force. Such measure of displacement provides an indication of the track stiffness and the conditions of the ties so that necessary repair to the track can be made. An example of such a device is shown in U.S. Pat. No. 3,808,693 to Plasser et al. and U.S. Pat. No. 5,756,903 to Norby et al.

Two distinct approaches have been used in implementing a railroad gage restraint measurement system. These approaches include mounting the railroad gage restraint measurement system under a standard freight truck, and mounting such a measurement system on a railcar body. Regardless of where the measurement system is mounted, the railroad gage restraint measurement system generally includes a split axle assembly, also referred to as a telescoping axle assembly, that allows the wheels to be displaced axially relative to one another.

In the first approach, the conventional gage restraint measurement system is mounted to the truck and the modified freight truck self-steers through curves with minimal effect on the applied lateral forces while always keeping a consistent angle of attack relative to the rail. Because the stock suspension is used, the ride comfort is maintained while the number of specialized components is minimized. The system is designed so that active controls are not needed for force control. This results in a very simple measurement system with a minimal number of components with reduced cost and complexity. However, if the railroad gage restraint measurement system is mounted on the truck as part of the running gear, the measurement system is significantly damaged if the axle derails. In addition, such a measurement system can lead to a total derailment of the railcar to which the railroad gage restrain measurement system is attached. This risk may be minimized by manually locating and identifying the track hardware that poses a derailment risk, and retracting the lateral force application when such track hardware is encountered. This procedure can be automated, but not without increased complexity and cost.

In the second approach, the conventional railroad gage restraint measurement system is mounted to the railcar body, and the system requires custom designed components, and possibly, active controls to maintain lateral position of the railcar body relative to the center of the track. In addition, this approach requires fine adjustments to maintain a consistent angle of attack. Furthermore, if active controls are not used for lateral positioning, frictional forces and mass effects can seriously impact the applied forces. Predicting these effects is nearly impossible until the measurement system is operating under normal loading conditions on the track. This results in a significant decrease in data quality due to the poor axle tracking, i.e. following rails of the track, and large variations in lateral force. Another disadvantage in mounting the measurement system to the railcar body is the resulting effect of unloading the vehicle's suspension. If the measurement system is mounted to the mid-span of the railcar body, the addition of a supporting axle mid-span of the railcar body will substantially modify the railcar's designed response to the dynamic bounce, pitch, and roll of the railcar during testing, these responses being important to evaluate performance at higher testing speeds. Lastly, the railcar's ride quality may be degraded due to the lack of a suspension between the loaded axle and the car body.

Regardless of which approach is employed, railroad gage restraint measurement systems generally include a split axle assembly with a sliding barrel device that functions in a telescoping manner to allow the wheels to be axially displaced relative to one another. A major disadvantage of the conventional split axle designs is that the bending moment that is transferred across the sliding barrel device to the opposing wheel on the railroad track is generally very high. The sliding surfaces of the sliding barrel device which allows it to function in a telescoping manner has a tendency to bind, i.e. become temporarily stuck. This tendency for binding increases as the bending moment increases. Such binding results in random locking of the telescoping action of the split axle assembly so that the split axle does not accurately follow the actual rails of the track. Binding of the split axle results in excessive variation in the lateral forces which result in poor quality measurement data being obtained. Further, such binding can damage the track with excessive forces when the gage of the track narrows and the split axle assembly binds during axial movement.

FIG. 1A is a moment diagram for the currently used split axle assembly 100 that meets the requirements of the Federal Railroad Administration (hereinafter "FRA"), only one side of the split axle assembly 100 being shown. As shown, axle 102 is attached to the wheel 106 where a vertical force ($F_V$) is applied to axle 102 via bearing 104. The vertical force applied to bearing 104 results in vertical load (V) of approximately 20,000 lbs on wheel 106. In addition, a lateral force ($F_L$) is also applied to wheel 106 as the predetermined force resulting in a lateral load (L) of approximately 14,000 lbs that is exerted on wheel 106. Both of these forces result in a moment (M) of approximately 37,650 ft-lbs that must be transferred to the opposing wheel (not shown) on the railroad track.

FIG. 1B shows the hydraulic balancing moment correction for the conventional approved split axle assembly 100 of FIG. 1A which meets the FRA requirements. The correction moment is generated by hydraulic cylinders (not shown) to transfer the major balancing moment to the opposing axle half. In the illustrated example implementation of a conventional split axle assembly 100, approximately 22,000 lbs of force must be exerted from the top of wheel 106 while approximately 36,000 lbs of force must be exerted toward the bottom of wheel 106 in the opposing direction.

To generate this rather large balancing moment, four hydraulic cylinders (not shown) are generally mounted at specific distances from the center of the axle 102 and apply lateral loads via the push-plates 108 (one shown). The net lateral load from these hydraulic cylinders is the applied force to the railroad track, i.e. lateral load (L) of 14,000 lbs. The sliding barrel (not shown) connecting the two axles of the split axle assembly 100 only has to transfer the variations in the moment. With enough lubrication, this can be done without causing the split axle 102 to bind within the sliding barrel, yielding good gage following performance, and good lateral force control. However, since the hydraulic cylinders are applying opposing forces, a large amount of stress is generated in the push-plates 108 and the sliding barrel thereby requiring a significant amount of material to resist deflection. The amount of material required to resist deflection adds significant cost and weight to the components of the split axle assembly making the axle weigh approximately 6,250 lbs.

U.S. Pat. No. 5,756,903 to Norby et al. discloses a track strength testing vehicle with a loaded gage axle. The loaded gage axle described in Norby et al. includes a split axle assembly where the shafts having a spindle are supported in a housing, and the wheels are supported by bearings inside the wheels which allow the wheels to rotate about the spindles. The reference further discloses that the wheels and the shafts are axially movable and are forced outward by hydraulic cylinders, the shafts being axially supported inside the housing by ultra-high molecular weight plastic slides. In use, however, the shafts of Norby et al. have also been found to bind within the housing thereby causing poor lateral tracking of the rails of the tracks, and also causing significant variations in the exerted lateral force which results in inaccurate gage measurements and measurement data.

Therefore, in view of the above, there exists an unfulfilled need for a split axle assembly for a gage restraint measurement system that avoids the disadvantages of the prior art. In particular, there still exists an unfulfilled need for a split axle assembly that significantly reduces the balancing moment required so that the associated load bearing components may be reduced in size, weight, and correspondingly, cost. In addition, there still exists an unfulfilled need for a split axle assembly that improves lateral tracking of the rails of the track and facilitates maintaining of consistent lateral force to provide accurate gage measurements and measurement data.

SUMMARY OF THE INVENTION

In view of the above, one advantage of the present invention is in providing a novel and improved gage restraint measurement system which allows evaluation of a railroad track to improve railroad safety and maintenance efficiency.

A further advantage of the present invention is in providing a novel and improved inner bearing split axle assembly that significantly reduces the balancing moment required so that the associated load bearing components may be reduced in size, weight, and cost.

Still another advantage of the present invention is in providing a split axle assembly that improves tracking of the rails and facilitates maintaining of consistent lateral force to provide accurate gage measurements and measurement data.

Yet another advantage of the present invention is in providing a split axle assembly that minimizes binding to facilitate axial movement of wheels.

These and other advantages are attained by a split axle assembly for obtaining gage measurements of a track in accordance with the present invention comprising a first wheel and a second wheel sized to roll along the track, the first wheel being laterally spaced from the second wheel, a first split axle secured to the first wheel so that the first split axle rotates with the first wheel, a second split axle secured to the second wheel so that the second split axle rotates with the second wheel, a first bearing for rotatably receiving the first split axle, and a second bearing for rotatably receiving the second split axle, where the first bearing and the second bearing are positioned inboard between the first wheel and the second wheel.

In accordance with one embodiment, the split axle assembly also includes brackets adapted to secure the split axle assembly to a truck or railcar body to allow lowering of the split axle assembly to an operative state, and to retract the split axle assembly to an inactive state. In this regard, one or more cylinders may be provided which is pivotally attached to the brackets that is operable to lower or retract the split axle assembly. The cylinders may be hydraulic cylinders and/or pneumatic cylinders.

In accordance with one implementation, the split axle assembly may be provided with a sliding barrel device adapted to allow the first wheel and the second wheel to axially move relative to one another. In this regard, the sliding barrel device includes an outer barrel, and at least one inner barrel axially movable in the outer barrel. Preferably, a first inner barrel and a second inner barrel is provided, the first inner barrel being connected to the first split axle and the second inner barrel being connected to the second split axle. In addition, the split axle assembly may further be provided with one or more cylinders for axially moving the first inner barrel and the second inner barrel relative to each other. In this regard, the cylinders may be hydraulic cylinders and/or pneumatic cylinders.

In accordance with another embodiment of the split axle assembly, the first bearing is received in a first bearing body and the second bearing is received in a second bearing body, the first bearing body and the second bearing body being axially movable relative to one another so that the first wheel and the second wheel are axially movable relative to one another. In this regard, a plurality of linear guides may be provided for allowing axial movement of the first bearing body and the second bearing body relative to one another. In one implementation, the plurality of linear guides include guide rails and guide rollers attached to the first bearing body and the second bearing body, the guide roller attached to the first bearing body movably engaging the guide rail attached to the second bearing body, and the guide roller attached to the second bearing body movably engaging the guide rail attached to the first bearing body.

In other embodiments, the guide rollers may include a wiper for removing debris from the guide rails as the guide rollers movably engage the guide rails. The guide rails may include a rail stop adapted to limit axial movement of the guide rollers. In addition, the guide rails may be offset from the first and second bearing bodies by spacer blocks.

In accordance with another embodiment of the present invention, one or more cylinders are provided which is adapted to axially move the first bearing body and the second bearing body relative to each other, the cylinders being attached to the first bearing body and the second bearing body. The cylinders may be implemented as hydraulic cylinders and/or pneumatic cylinders. In addition, a load cell may be provided which is adapted to measure lateral force exerted on the first wheel and/or the second wheel. In this regard, a thrust bearing may be disposed adjacent to the load cell and abutting the first split axle and/or the second split axle. Moreover, a stop may be provided to limit the amount of lateral force that is exerted on the load cell.

These and other advantages and features of the present invention will become more apparent from the following detailed description of the preferred embodiments of the present invention when viewed in conjunction with the accompanying drawings.

DESCRIPTION OF THE PREFERRED EMBODIMENT

Figure 2A:
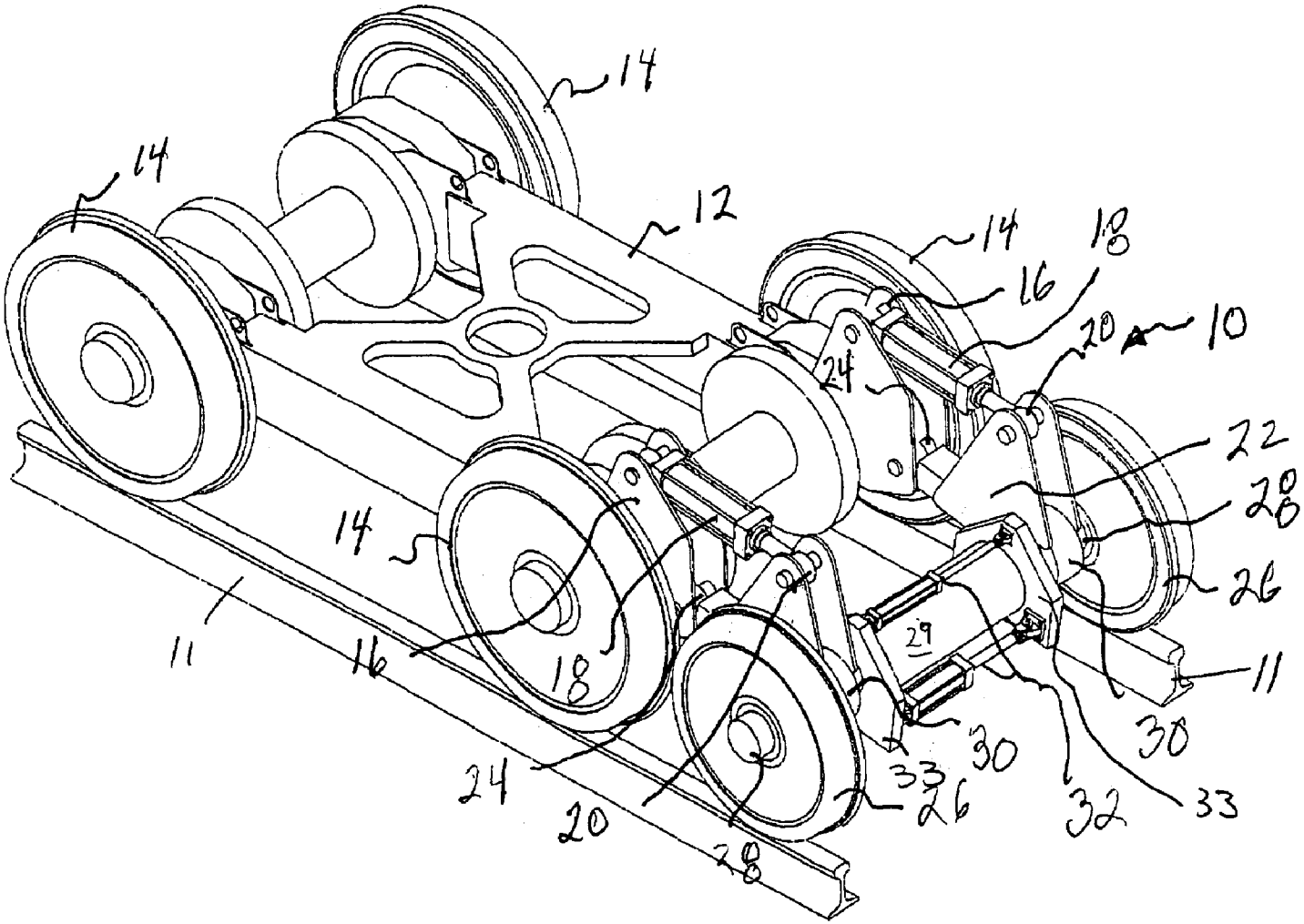
FIG. 2A is a perspective view of an inner bearing split axle assembly in accordance with one embodiment of the present invention.

FIG. 2A shows a split axle assembly 10 for use in a gage measurement system in accordance with one embodiment of the present invention. As will be explained below, the split axle assembly 10 significantly reduces the balancing moment required so that the associated load bearing components may be reduced in size, in weight, and, correspondingly, in cost. In particular, to reduce the balancing moment, as well as the size and weight of the gage measurement system, the split axle assembly 10 of the present invention as shown in FIG. 2A is provided with inner bearings as described in further detail below which are positioned inboard of the wheels of the split axle assembly 10.

The inner bearing split axle assembly 10 shown in FIG. 2A is illustrated as being mounted to a truck 12 of a railcar (not shown) having four track engaging wheels 14 that roll along the track 11. Of course, it should be understood that the term "railcar" as used herein broadly refers to any vehicle designed to be moved along a track such as trains, underground subway, and trolleys. Thus, the present invention is not limited to railroad applications, but may also be effectively used for rail trolleys, subway systems and the like. Correspondingly, it should also be understood that the term "track" may refer to railroad, subway, or trolley tracks, etc.

The split axle assembly 10 of the illustrated embodiment includes side frame extensions 16 connected to the truck 12 that allow mounting of vertical load applying hydraulic cylinders 18. The hydraulic cylinders 18 are connected at pivots 20 to the brackets 22 of the split axle assembly 10. Brackets 22 are pivotally mounted at pivotal mounts 24 to the truck 12 so that the hydraulic cylinders 18 can extend to cause the brackets 22 to pivot about the pivotal mount 24 thereby causing the wheels 26 of the inner bearing split axle assembly 10 to contact the track 11. Thus, the wheels 26 of the inner bearing split axle assembly 10 may be lowered into an operational state so that the wheels 26 assume the load of the front wheels 14 of the truck 12. Of course, whereas hydraulic cylinders 18 are illustrated in the embodiment of FIG. 2A, pneumatic cylinders may be used in other embodiments instead.

The linearly aligned split axles 28 are secured to the wheels 26 and are enclosed in the two axle covering bearing bodies 30. The split axles 28 are axially movable relative to each other via the sliding barrel device 29 so that the wheels 26 are correspondingly axially movable as well. The bearing bodies 30 are connected together by push plates 33 and hydraulic cylinders 32 secured thereto that exert lateral force to the track 11 via the wheels 26 to allow obtaining of gage measurement data. In particular, the hydraulic cylinders 32 allow application of predetermined lateral force on the push plates 33 that is transferred to the rails of the track 11 so that lateral displacement of the track 11 may be measured. Based on the applied lateral force and the resulting lateral displacement of the track 11, the track stiffness and the conditions of the ties may be determined so that any necessary repair can be made. Moreover, as discussed below, the hydraulic cylinders 32 are also adapted to generate lateral forces against the bearing bodies 30 to substantially cancel the bending moments caused by downward pressure on the split axle assembly 10. Of course, in other embodiments, pneumatic cylinders may be used instead of, or in conjunction with, the hydraulic cylinders 32 shown in the illustrated implementation.

Figure 2B:
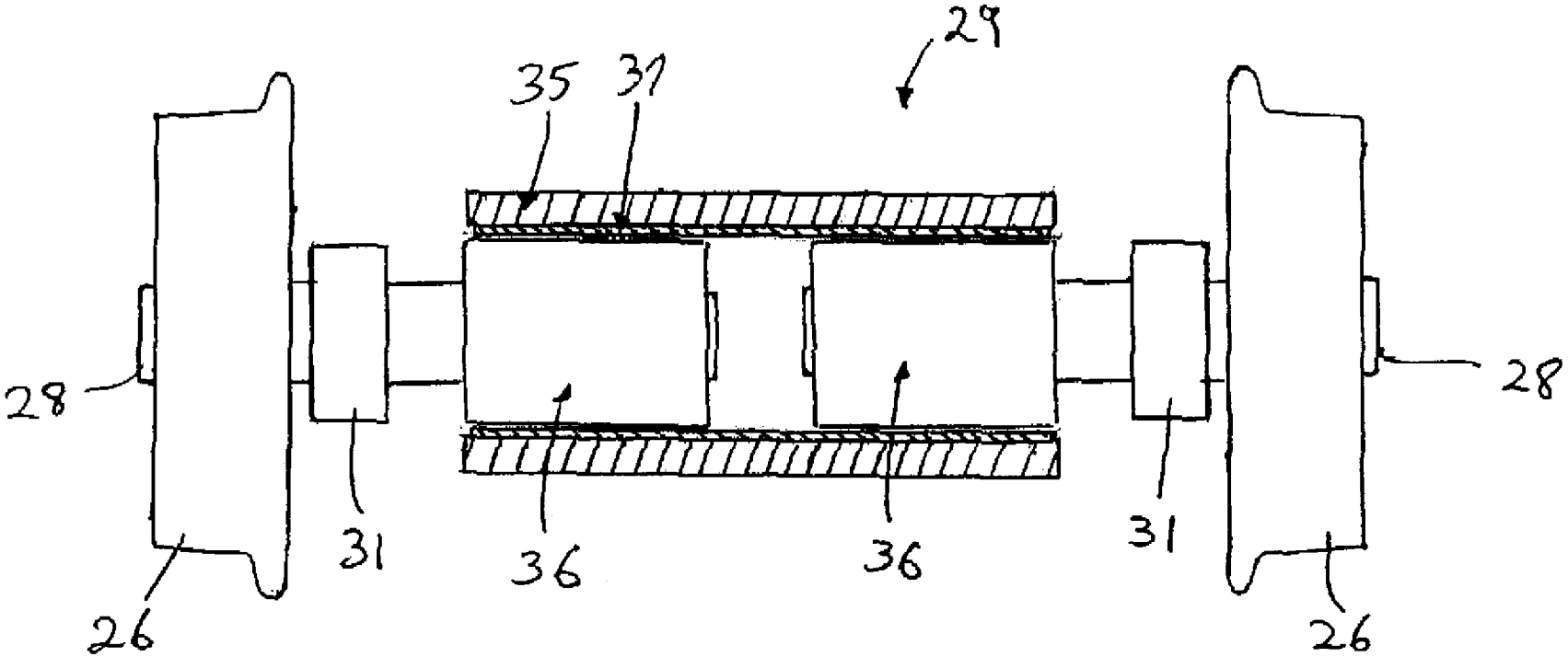
FIG. 2B is a partial cross sectional view of a sliding barrel device of the inner bearing split axle assembly of FIG. 2A.

FIG. 2B is a partial cross sectional view of the sliding barrel device 29 of the inner bearing split axle assembly 10 illustrated in FIG. 2A in accordance with one embodiment. The sliding barrel device 29 allows the split axles 28 to be axially movable relative to each other so that the wheels 26 are correspondingly axially movable as well. The sliding barrel device 29 includes an outer barrel 35 having a cavity for receiving inner barrels 36 therein. In particular, the linearly aligned split axles 28 are secured to the wheels 26 and connected to the inner barrels 36 that are axially movable in the outer barrel 35 so that the wheels 26 follow the track. In this regard, the outer barrel 35 of the illustrated embodiment of FIG. 2B is also provided with a bushing 37 to reduce friction and facilitate axial movement of the inner barrels 36 in the outer barrel 35. The bushing 37 may be made of bronze or any other appropriate material. As explained in further detail below, the inner bearing split axle assembly 10 significantly differs from split axle assemblies in that the bearings 31 which are adapted to rotatably receive the split axle 28 are provided inboard of the wheels 26.

Figure 1B:
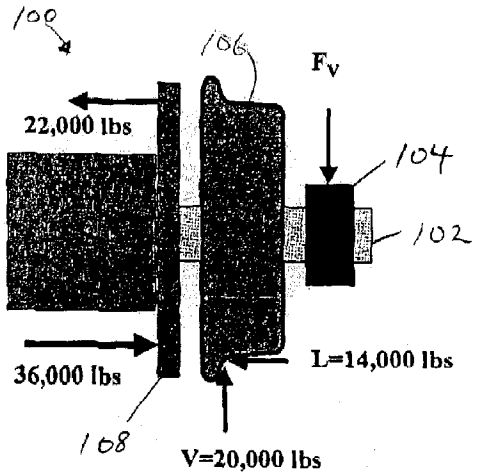
Fig. 1B (Prior Art)
FIG. 1B is a schematic diagram showing the hydraulic balancing moment correction for the FRA split axle assembly of FIG. 1A.
Figure 3B:
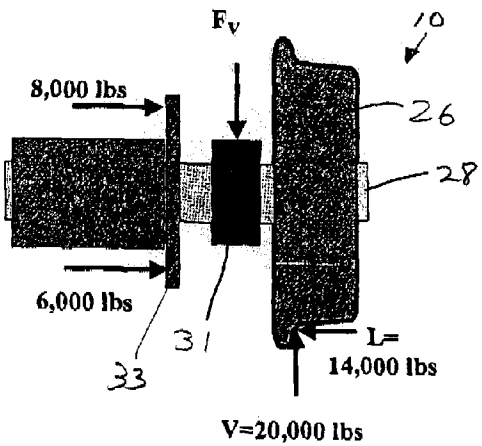
FIG. 3B is a schematic diagram showing the hydraulic force for generating the balancing moment correction for the split axle assembly of FIG. 3A.
Figure 3A:
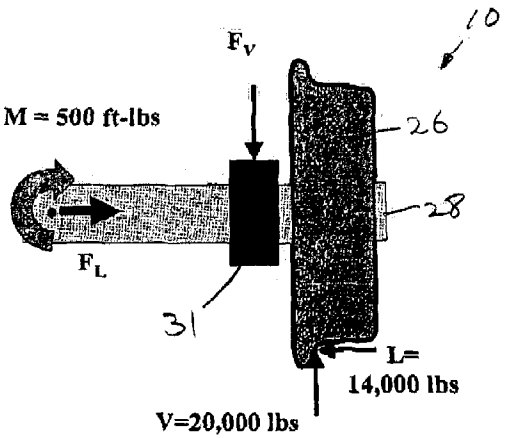
FIG. 3A is a schematic diagram showing the required balancing moment for the split axle assembly in accordance with one embodiment of the present invention.

FIG. 3A is a schematic force diagram showing the required balancing moment for the inner bearing split axle assembly 10 of FIG. 2A, only one split axle and wheel being shown. Similarly, FIG. 3B is a schematic force diagram showing the hydraulic force required to generate the balancing moment correction. As shown in FIG. 3A, in the split axle assembly 10 of the illustrated embodiment, the wheel 26 is securely attached to the split axle 28 so that they rotate together. In addition, in contrast with the conventional split axle assembly shown in FIGS. 1A and 1B, the split axle assembly 10 of the present invention is provided with bearing 31 housed within the bearing body 30 that is inboard of the wheel 26. As shown, the bearing 31 is adapted to receive the split axle 28 there through so that the split axle 28 rotates within the bearing 31 as the wheel 26 rotates along the track 11. The vertical force ($F_V$) is applied to the split axle 28 via the bearing 31 housed in the bearing body 30 when the split axle assembly 10 is engaging the track 11.

As previously noted, the significant difference in design provided by split axle assembly 10 in accordance with the present invention is that the bearing 31 is positioned inboard of the wheel 26. This placement of the bearing 31 results in a significant decrease in the requirements of the hydraulic cylinder, as well as the size and associated weight of the supporting push-plates 33. In addition, internal friction of the slide barrel 29 that resists axial movement of the wheels 26 and tend to cause binding of the split axles 28 is significantly reduced so that the dynamic response characteristics of the split axle assembly 10 is greatly improved as compared to conventional split axle assemblies which tend to bind and provide inaccurate gage measurement data.

Figure 1A:
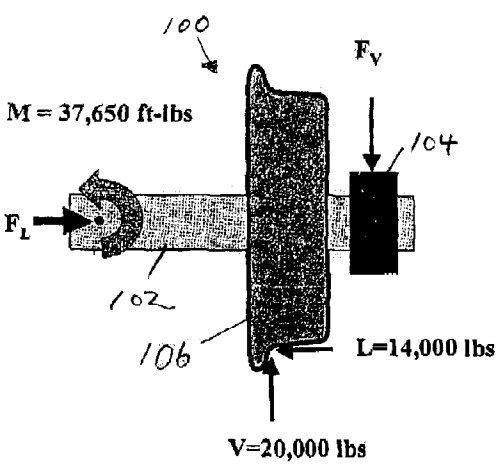
Fig. 1A (Prior Art)
FIG. 1A is a schematic diagram showing the required balancing moment for a Federal Railroad Administration (FRA) split axle assembly of the prior art.

By providing the bearings 31 of the split axle assembly 10 that are inboard of the wheels 26, the moment generated by the lateral force on the wheels 26 nearly cancels the moment caused by the vertical force on the bearings 31. In the illustrated embodiment of FIG. 3A, the required balancing moment may be reduced to 500 ft-lbs by carefully placing the vertical load and by choosing a 28 inch diameter or other appropriately sized wheel, for example. This required balancing moment may then be generated with reduced hydraulic forces as shown in FIG. 3B which are significantly reduced in comparison to the very high balancing moments of the prior art as shown in FIG. 1A. In the illustrated example, the positioning of the bearings 31 of the split axles 28 inboard of the wheels 26 reduces the forces required to generate the balancing moment by approximately 75%. Correspondingly, the cost and required material of the push-plates 33 required to support the exerted loads is also significantly reduced. Moreover, the requirements of the hydraulic cylinders 32 are also significantly reduced allowing, thereby allowing smaller hydraulic cylinders to be used and further reducing costs.

In the illustrated embodiment of FIG. 2A, the split axle assembly 10 is mounted on the truck 12 in the manner shown. However, it should also be noted that the split axle assembly 10 may alternatively be mounted to the railcar body or other articulating mounting device in other embodiments as well. In such an embodiment, the railcar body or articulating mounting device may be provided with mounts sized to pivotally attach the hydraulic cylinders 18, and pivotal mounts to allow the split axle assembly 10 to be lowered into an operative state, and retracted to an inactive state when not in use. Of course, as previously noted, the railcar body may be a subway car body or a trolley car body as well, and additional modifications may be implemented to allow mounting of the split axle assembly 10 in such applications.

Figure 4:
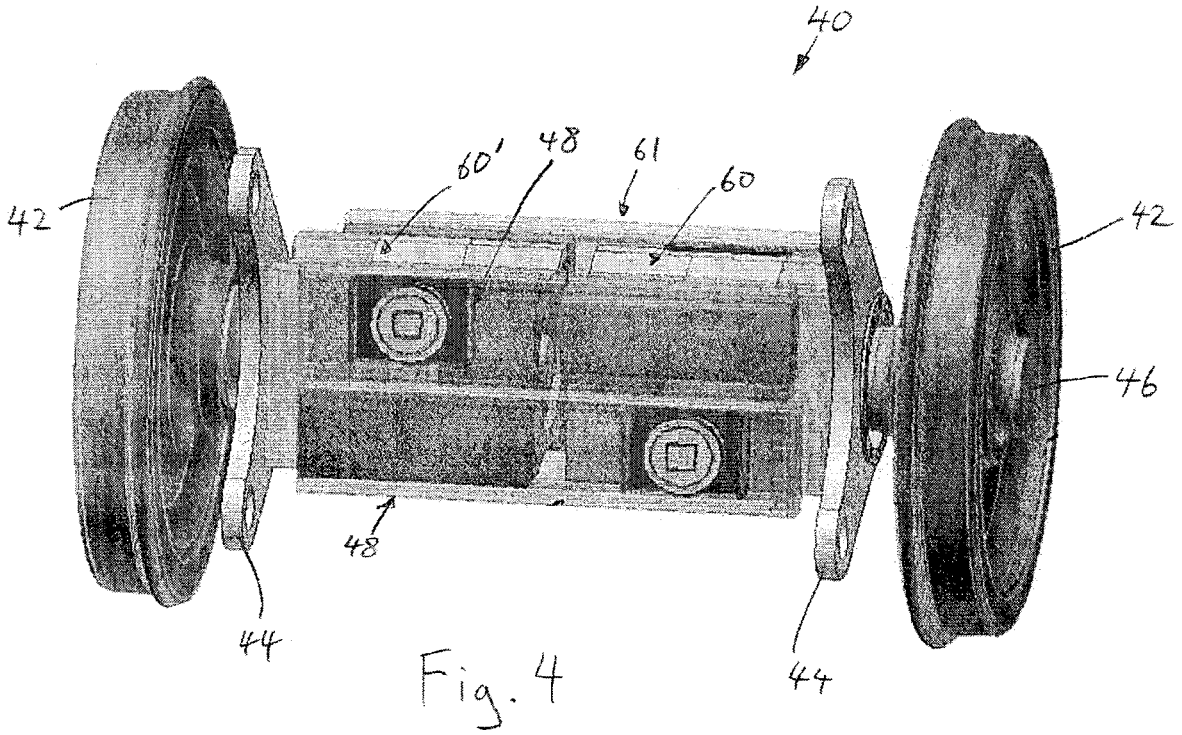
FIG. 4 is a perspective view of a split axle assembly in accordance with another embodiment of the present invention.

FIG. 4 is a perspective view of a split axle assembly 40 in accordance with another embodiment of the present invention that may be pivotably secured to a truck or a railcar body for use in a gage restraint measurement system. As can be seen, the split axle assembly 40 is shown in FIG. 4 by itself, without being mounted to a truck or a railcar body. As discussed in detail below, the split axle assembly 40 of the illustrated embodiment of FIG. 4 significantly reduces the balancing moment required like the previously described embodiment of FIGS. 2A to 3B so that the associated components may be reduced in size, in weight, and in cost. In addition, as will also be evident from the discussion below, the split axle assembly 40 minimizes the potential for binding, thus improving tracking of the rails of the track and maintaining consistent lateral force to thereby provide accurate gage measurements and gage measurement data.

As shown, the split axle assembly 40 includes wheels 42 that contact the track (not shown) when the split axle assembly 40 is lowered to an operative state. The split axle assembly 40 includes brackets 44 which allow mounting of the split axle assembly 40 to a truck or a railcar body. In addition, the brackets 44 also allow pivoting of the split axle assembly 40 between a lowered, operative position, and a retracted, inactive position. In this regard, hydraulic cylinders (not shown) that are pivotably attached to the brackets 44 may be provided to control the position of the split axle assembly 40 over the track. The mounting and general operation of the split axle assembly 40 is substantially similar to that described above relative to the previous embodiment of FIG. 2A. Thus, the details of such mounting and general operation are omitted for clarity and to avoid repetition.

The wheels 42 are secured to the split axles 46 so that the split axles 46 rotate with the wheels 42 when the split axle assembly 40 is in operation. The split axles 46 allow the wheels 42 to move axially relative to one another so that a lateral force may be exerted to the track, and gage measurements may be obtained to measure the lateral displacement of the track. As previously discussed, gage measurements obtained in such a manner provide an indication of the track stiffness and the conditions of the ties so that necessary repair can be readily determined. In this regard, the split axle assembly 40 includes linear guide assemblies 48, the details of which are discussed below, that minimize binding as the wheels 42 move axially relative to one another thereby allowing the wheels 42 to accurately follow the track.

Figure 5:
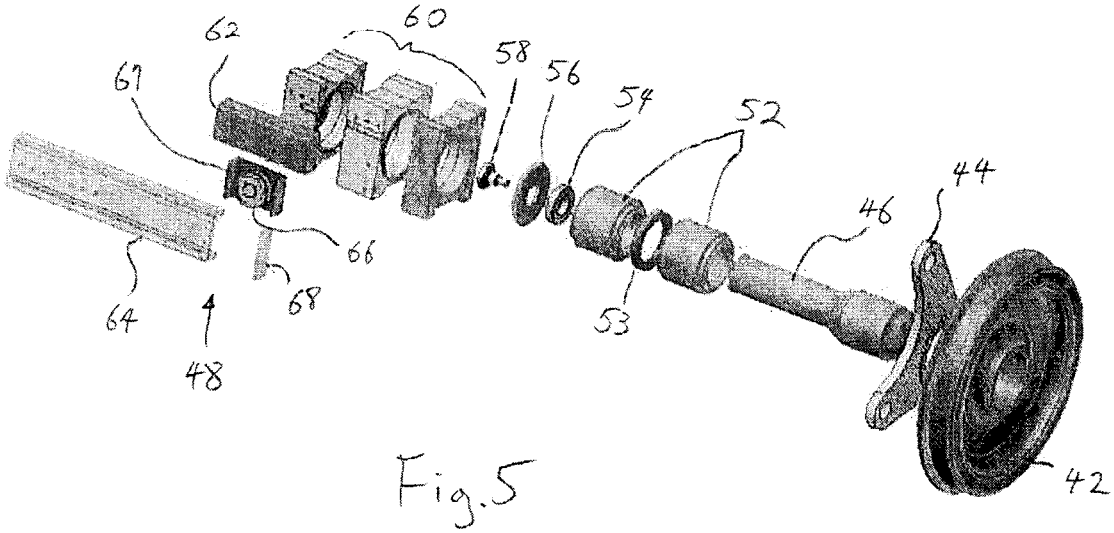
FIG. 5 is an exploded view of one side of the split axle assembly of FIG. 4.

FIG. 5 is an exploded view of one side of the split axle assembly 40 of FIG. 4 which more clearly shows the various split axle components of the present embodiment. Of course, the split axle assembly 40 also includes an adjacent side which is not illustrated in FIG. 5 for clarity purposes. However, the adjacent side of the split axle assembly 40 would be substantially the same as the side shown in FIG. 5.

Figure 6:
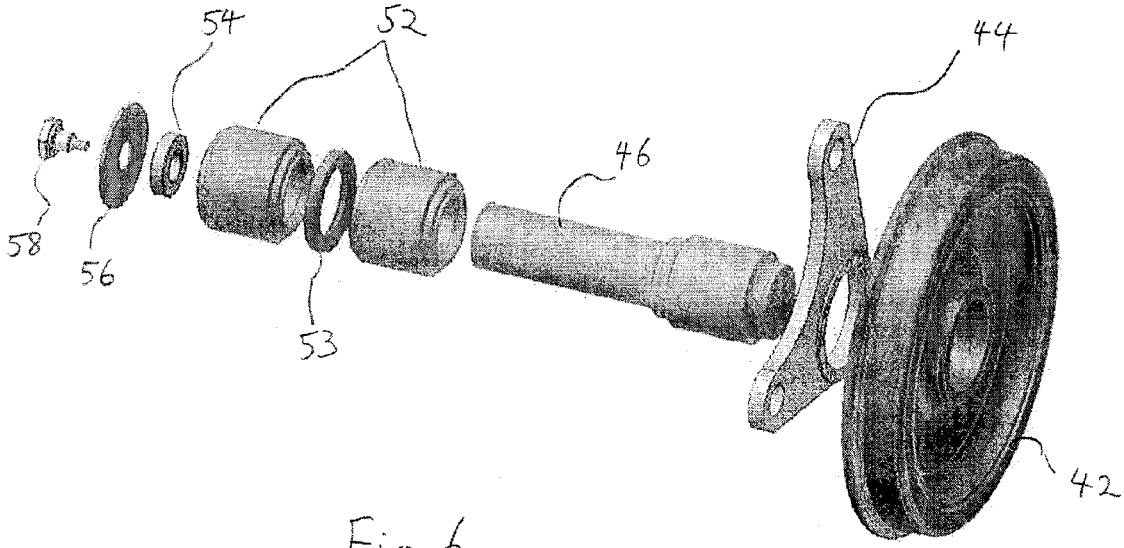
FIG. 6 is an enlarged view of the axle components of FIG. 5.

In addition to the previously described wheels 42, split axles 46, and brackets 44, the split axle assembly 40 also includes various other axle components which are most clearly shown in FIG. 6. These axle components of the split axle assembly 40 include bearings 52 that receive the split axle 46 therein to allow the split axle 46 to rotate with the wheel 42. In the illustrated embodiment, two bearings 52 are provided, a spacer 53 separating the bearings 52. Of course, in other embodiments, different number of bearings may be used instead. In addition, a thrust bearing 54 is provided which allow the rotating split axle 46 to contact and exert a force on a load cell 56 to allow measurement of the lateral forces exerted on the track via wheel 42, as well as the position of the wheels 42. A safety stop 58 is also provided to limit the amount of force that can be exerted on the load cell 56 by the split axle 46 to ensure that the load cell 56 is not damaged during use. In other embodiments, an instrumented wheel(s) may be used for measuring the lateral force instead of providing a load cell 56.

In a manner previously described relative to FIGS. 2A to 3B, the bearings 52 which support the vertical forces via the split axles 46 are positioned inboard of the wheels 42 as clearly shown in the enlarged illustration of FIG. 6. Therefore, the moment generated by the lateral force on the wheel 42 nearly cancels the moment caused by the vertical force on the bearings 52. Correspondingly, capacity of the cylinders and the associated components required to support the exerted loads can be significantly reduced thereby reducing weight and cost.

Figure 7:
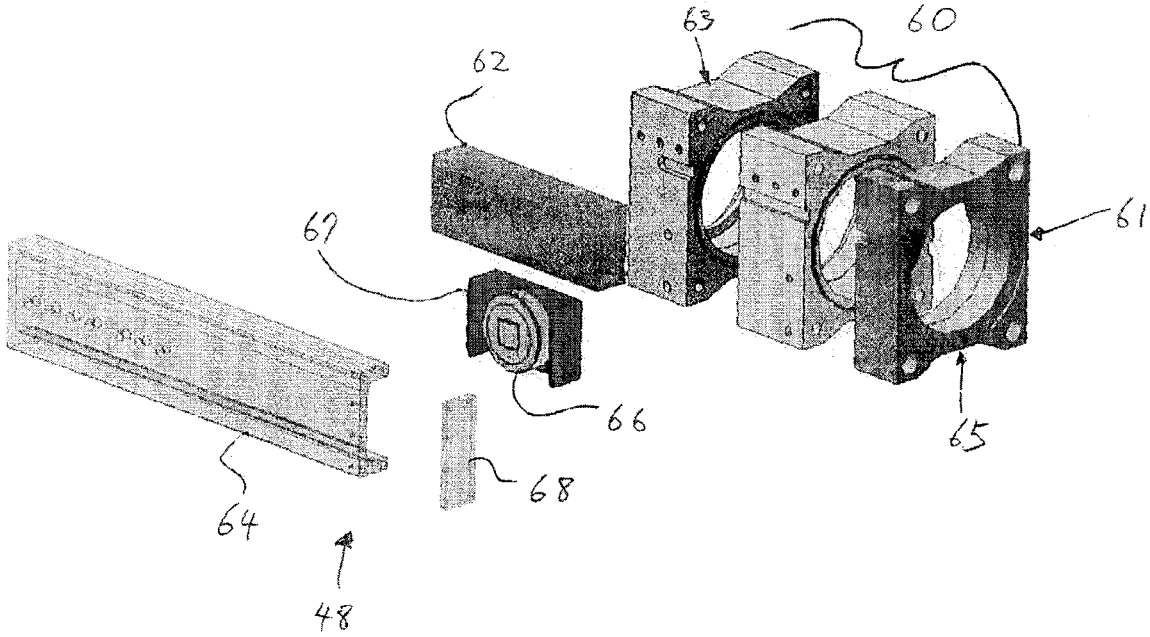
FIG. 7 is an enlarged view of the linear guide components of FIG. 5.

FIG. 5 also shows the assembly view of the linear guide 48, an enlarged view of the linear guide 48 and other components being shown in FIG. 7. As shown, the bearings 52 that receive the spilt axle 46 are housed in the bearing body 60 to which the linear guide 48 is attached. The bearing body 60 allows the vertical and lateral forces to be exerted on the wheel 42 while the linear guide 48 allows these forces to be transferred across the split axle assembly 40 to the adjacent wheel. It is noted that whereas in the illustrated figure, the bearing body 60 is shown as three separate components, in other embodiments, the bearing body 60 may be implemented as a single component, as two components, or any number of components. The split axle assembly 40 is also provided with a spacer block 62 that is secured together with the guide rail 64 to the bearing body 60 via fasteners (not shown), or any other appropriate manner. The spacer block 62 spaces the guide rail 64 away from the bearing body 60. In the illustrated embodiment, a guide roller 66 is secured to the bearing body 60 adjacent to the attached guide rail 64. The guide roller 66 of the illustrated embodiment is provided with a wiper 67 and the guide rail 64 is provided with a rail stop 68 that is attached to one end of the guide rail 64, the functions of these components being described in detail below.

Referring again to FIG. 4, the split axle assembly 40 is provided with a plurality of linear guides 48 that are mounted to the first bearing body 60 and the second bearing body 60' on the right and left sides, respectively, of the split axle assembly 40 shown in FIG. 4. The vertical position of the guide rail 64 and the guide roller 66 on the first and second bearing bodies 60 and 60' are alternated as shown in FIG. 4 so that the guide roller 66 secured to one side of the split axle assembly 40 is received in the guide rail 64 secured to the other side of the split axle assembly 40. Hence, as shown, for the right side of the split axle assembly 40, the guide roller 66 is secured to the first bearing body 60 below the guide rail 64. For the left side of the split axle assembly 40, the guide roller 66 is secured to the second bearing body 60 above the guide rail 64.

The above alternated arrangement allows the guide rollers 66 to movably engage the guide rails 64 that are secured to the bearing body on the opposite side of the split axle assembly 40. This allows the first bearing body 60 and the second bearing body 60' to move axially relative to one another. In particular, the guide roller 66 that is attached to the first bearing body 60 movably engages the guide rail 64 attached to the second bearing body 60'. In addition, the guide roller 66 that is attached to the second bearing body 60' movably engages the guide rail 64 attached to the first bearing body 60. Thus, the above described arrangement of the linear guides 48 allows the first bearing body 60 and the second bearing body 60' to axially move relative to one another so that the wheels 42 of the split axle assembly 40 are likewise movable relative to one another. Moreover, the axial movement is attained with minimal binding even when the vertical forces exerted on the first and second bearing bodies 60 and 60' are high.

It should be noted that in the illustrated embodiment of FIG. 4, linear guides 48 are also preferably provided on the back side 61 of the split axle assembly 40 to further minimize potential for binding, and to increase the load carrying capacity of the split axle assembly 40. Thus, the illustrated embodiment would be provided with a total of four linear guides 48. Of course, in other embodiments, different number of linear guides 48 may be provided depending on the anticipated loads and application. For example, for very light load applications, a single linear guide may be used.

In operation, cylinders (not shown) such as hydraulic cylinders shown relative to the embodiment of FIG. 2A, or pneumatic cylinders may be provided along the grooved upper surface 63 and grooved lower surface 65 of the bearing body 60 as shown in FIG. 7. These cylinders may be attached to the first bearing body 60 and the second bearing body 60' of the split axle assembly 40. Such cylinders allow exertion of lateral loads to the track via the split axles 46 and the wheels 42, and also allow measurement of track displacement. As the wheels 42 of the split axle assembly 40 roll on the track, any variation in gage dimension of the track can be accurately followed by the wheels 42 since the linear guides 48 allow relative axial movement between the wheels 42. In this regard, the wheels 42 move axially outward as the gage dimension of the track increases or the track is laterally displaced under load, and the wheels 42 move axially inward as the gage dimension of the track decreases. Such gage measurement data may then be used to determine track stiffness, tie conditions, or other track parameters in the manner previously described.

In addition, as the guide rollers 66 move within their respective guide rails 64, the wipers 67 ensure that the guide rails 64 are free of debris that may impede the movement of the guide rollers 66 along the guide rails 64. The rail stops 68 also prevent the guide rollers 66 from moving out of the guide rails 64 when the wheels 42 of the split axle assembly 40 are moved axially outward as far as possible.

It should now be evident how the present invention provides a unique split axle assembly for use in a gage measurement system which significantly reduces the balancing moment required by providing bearings which are positioned inboard of the wheels. This allows the associated load bearing components to be reduced in size, in weight, and in cost. In addition, it should also be evident how the present invention provides a split axle assembly that reduces the potential for binding, thus improving lateral tracking of the rails of the track and facilitating maintaining of consistent lateral force to provide accurate gage measurements and measurement data.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

We claim:

1. A split axle assembly for obtaining gage measurements of a track comprising:

a first wheel and a second wheel sized to roll along said track, said first wheel being laterally spaced from said second wheel;

a first split axle secured to said first wheel so that said first split axle rotates with said first wheel;

a second split axle secured to said second wheel so that said second split axle rotates with said second wheel;

a first bearing positioned inboard between said first wheel and said second wheel said first split axle being rotatably received in said first bearing;

a second bearing positioned inboard between said first wheel and said second wheel said second split axle being rotatably received in said second bearing; and a sliding barrel device with an outer barrel, a first inner barrel connected to said first split axle, and a second inner barrel connected to said second split axle, said first and second inner barrels being axially movable in said outer barrel to allow said first wheel and said second wheel to axially move relative to one another, and a friction reduction means for reducing friction between said outer barrel and said inner barrels.

2. The split axle assembly of claim 1, further including a means for canceling at least a portion of a bending moment exerted on said split axle assembly, said means being positioned between said first and second wheels, and transferring loading force between said split axles and at least one of a truck and a railcar body, wherein said means for canceling at least a portion of a bending moment includes at least one bracket.

3. The split axle assembly of claim 2, wherein said at least one bracket is a first bracket and a second bracket disposed proximate to said first wheel and said second wheel, respectively.

4. The split axle assembly of claim 2, wherein said at least one bracket is further adapted to allow lowering of said split axle assembly to an operative state, and retraction of said split axle assembly to an inactive state.

5. The split axle assembly of claim 4, further comprising at least one cylinder attached to said at least one bracket, said at least one cylinder being operable to lower said split axle assembly to said operative state, and retract said split axle assembly to said inactive state.

6. The split axle assembly of claim 5, wherein said at least one cylinder is at least one of a hydraulic cylinder and a pneumatic cylinder.

7. The split axle assembly of claim 2, wherein said means for canceling at least a portion of said bending moment exerted on said split axle assembly includes at least one cylinder.

8. The split axle assembly of claim 1, wherein said first bearing is received in a first bearing body and said second bearing is received in a second bearing body.

9. The split axle assembly of claim 1, wherein said track is a railroad track.

10. The split axle assembly of claim 1, wherein said track is at least one of a subway track and a trolley track.

11. A split axle assembly for obtaining gage measurements of a track comprising:

a first wheel and a second wheel sized to roll along said track, said first wheel being laterally spaced from said second wheel;

a first split axle secured to said first wheel so that said first split axle rotates with said first wheel;

a second split axle secured to said second wheel so that said second split axle rotates with said second wheel;

a first bearing positioned inboard between said first wheel and said second wheel said first split axle being rotatably received in said first bearing;

a second bearing positioned inboard between said first wheel and said second wheel said second split axle being rotatably received in said second bearing;

a means for canceling at least a portion of a bending moment exerted on said split axle assembly, said means being positioned between said first and second wheels, and transferring loading force between said split axles and at least one of a truck and a railcar body; and a sliding barrel device adapted to allow said first wheel and said second wheel to axially move relative to one another;

wherein said sliding barrel device includes an outer barrel, and at least one inner barrel axially movable in said outer barrel;

wherein said at least one inner barrel is a first inner barrel, and a second inner barrel, said first inner barrel being connected to said first split axle and said second inner barrel being connected to said second split axle.

12. The split axle assembly of claim 11, wherein said means for canceling at least a portion of said bending moment exerted on said split axle assembly includes at least one cylinder for axially moving said first inner barrel and said second inner barrel relative to each other.

13. The split axle assembly of claim 12, wherein said at least one cylinder is at least one of a hydraulic cylinder and a pneumatic cylinder.

14. A split axle assembly for obtaining gage measurements of a track comprising:

a first wheel and a second wheel sized to roll along said track, said first wheel being laterally spaced from said second wheel;

a first split axle secured to said first wheel so that said first split axle rotates with said first wheel;

a second split axle secured to said second wheel so that said second split axle rotates with said second wheel;

a first bearing positioned inboard between said first wheel and said second wheel said first split axle being rotatably received in said first bearing;

a second bearing positioned inboard between said first wheel and said second wheel said second split axle being rotatably received in said second bearing; and a means for canceling at least a portion of a bending moment exerted on said split axle assembly, said means being positioned between said first and second wheels, and transferring loading force between said split axles and at least one of a truck and a railcar body;

wherein said first bearing is received in a first bearing body and said second bearing is received in a second bearing body;

wherein said first bearing body and said second bearing body are axially movable relative to one another so that said first wheel and said second wheel are axially movable relative to one another.

15. A split axle assembly for obtaining gage measurements of a track comprising:

a first wheel and a second wheel sized to roll along said track, said first wheel being laterally spaced from said second wheel;

a first split axle secured to said first wheel so that said first split axle rotates with said first wheel;

a second split axle secured to said second wheel so that said second split axle rotates with said second wheel;

a first bearing positioned inboard between said first wheel and said second wheel, said first bearing being received in a first bearing body, and said first split axle being rotatably received in said first bearing;

a second bearing positioned inboard between said first wheel and said second wheel, said second bearing being received in a second bearing body, and said second split axle being rotatably received in said second bearing, said first bearing body and said second bearing body being axially movable relative to one another so that said first wheel and said second wheel are axially movable relative to one another;

wherein said first bearing body and said second bearing body are axially movably connected together by at least one linear guide.

16. The split axle assembly of claim 15, wherein said at least one linear guide includes a guide rail attached to one of said first bearing body and said second bearing body, and a guide roller attached to the other of said first bearing body and said second bearing body, said guide roller movably engaging said guide rail.

17. A split axle assembly for obtaining gage measurements of a track comprising:

a first wheel and a second wheel sized to roll along said track, said first wheel being laterally spaced from said second wheel;

a first split axle secured to said first wheel so that said first split axle rotates with said first wheel;

a second split axle secured to said second wheel so that said second split axle rotates with said second wheel;

a first bearing positioned inboard between said first wheel and said second wheel, said first bearing being received in a first bearing body, and said first split axle being rotatably received in said first bearing;

a second bearing positioned inboard between said first wheel and said second wheel, said second bearing being received in a second bearing body, and said second split axle being rotatably received in said second bearing; and a plurality of linear guides for allowing axial movement of said first bearing body and said second bearing body relative to one another so that said first wheel and said second wheel are axially movable relative to one another.

18. The split axle assembly of claim 17, wherein said plurality of linear guides include guide rails and guide rollers attached to said first bearing body and said second bearing body.

19. The split axle assembly of claim 18, wherein said guide roller attached to said first bearing body movably engages said guide rail attached to said second bearing body.

20. The split axle assembly of claim 18, wherein said guide roller attached to said second bearing body movably engages said guide rail attached to said first bearing body.

21. The split axle assembly of claim 18, wherein said guide rollers include a wiper for removing debris from said guide rails as said guide rollers movably engage said guide rails.

22. The split axle assembly of claim 18, wherein said guide rails include a rail stop adapted to limit axial movement of said guide rollers.

23. The split axle assembly of claim 18, wherein said guide rails are offset from said first and second bearing bodies by spacer blocks.

24. The split axle assembly of claim 18, further comprising at least one cylinder adapted to axially move said first bearing body and said second bearing body relative to each other.

25. The split axle assembly of claim 24, wherein said at least one cylinder is at least one of a hydraulic cylinder and a pneumatic cylinder.

26. The split axle assembly of claim 24, wherein said at least one cylinder is attached to said first bearing body and said second bearing body.

27. A split axle assembly for obtaining gage measurements of a track comprising:

a first wheel and a second wheel sized to roll along said track, said first wheel being laterally spaced from said second wheel;

a first split axle secured to said first wheel so that said first split axle rotates with said first wheel;

a second split axle secured to said second wheel so that said second split axle rotates with said second wheel;

a first bearing disposed within a first bearing body positioned inboard between said first wheel and said second wheel, said first split axle being rotatably received in said first bearing;

a second bearing disposed within a second bearing body positioned inboard between said first wheel and said second wheel, said second split axle being rotatably received in said second bearing;

at least one linear guide adapted to allow said first bearing body and said second bearing body to axially movable relative to one another so that said first wheel and said second wheel are axially movable relative to one another, said at least one linear guide including a guide rail attached to one of said first bearing body and said second bearing body, and a guide roller attached to the other of said first bearing body and said second bearing body, said guide roller movably engaging said guide rail.

28. The split axle assembly of claim 27, further comprising a load cell adapted to measure lateral force exerted on at least one of said first wheel and said second wheel.

29. The split axle assembly of claim 27, further comprising a first bracket disposed proximate to said first wheel, and a second bracket disposed proximate to said second wheel, said first and second brackets being adapted to allow lowering of said split axle assembly to an operative state, and retraction of said split axle assembly to an inactive state.

30. A split axle assembly for obtaining gage measurements of a track comprising:

a first wheel and a second wheel sized to roll along said track, said first wheel being laterally spaced from said second wheel;

a first split axle secured to said first wheel so that said first split axle rotates with said first wheel;

a second split axle secured to said second wheel so that said second split axle rotates with said second wheel;

a first bearing positioned inboard between said first wheel and said second wheel, said first bearing being received in a first bearing body, and said first split axle being rotatably received in said first bearing;

a second bearing positioned inboard between said first wheel and said second wheel, said second bearing being received in a second bearing body, and said second split axle being rotatably received in said second bearing, said first bearing body and said second bearing body being axially movable relative to one another so that said first wheel and said second wheel are axially movable relative to one another;

a first plate disposed proximate to said first wheel, and a second plate disposed proximate to said second wheel; and at least one substantially lateral cylinder connected to at least one of said first and second plates for canceling at least a portion of a bending moment exerted on said split axle assembly.

* * * * *